United States Patent [19]

Namiki et al.

[11] 4,202,235

[45] May 13, 1980

[54] ELECTRONIC MUSICAL BOX

[75] Inventors: Yasushi Namiki, Higashi-Yamato; Akira Terashima, Hatano; Naomi Yoshizawa, Hiratsuka, all of Japan

[73] Assignee: Pilot Man-Nen Hitsu Kabushiki Kaisha, Tokyo, Japan

[21] Appl. No.: 873,829

[22] Filed: Jan. 31, 1978

[30] Foreign Application Priority Data

Dec. 9, 1977 [JP] Japan ..... 52-147830

[51] Int. Cl.[2] ..... G10H 5/00; G04B 21/08

[52] U.S. Cl. ..... 84/1.01; 84/1.03; 368/10; 368/83

[58] Field of Search ..... 84/1.01, 1.03, 1.28, 84/115, 462, 464; 58/152 R

[56] References Cited

U.S. PATENT DOCUMENTS

| | | | |
|---|---|---|---|
| 3,683,096 | 8/1972 | Peterson et al. | 84/115 |
| 3,871,247 | 3/1975 | Bonham | 84/115 |
| 3,878,750 | 4/1975 | Kapps | 84/1.03 |
| 3,890,871 | 6/1975 | Oberheim | 84/1.01 |
| 4,022,097 | 5/1977 | Strangio | 84/464 |
| 4,023,456 | 5/1977 | Groeschel | 84/115 |
| 4,089,246 | 5/1978 | Kooker | 84/1.03 |
| 4,090,349 | 5/1978 | Takase | 84/1.03 |
| 4,110,750 | 8/1978 | Heyning et al. | 84/1.01 |

*Primary Examiner*—Gene Z. Rubinson
*Assistant Examiner*—Forester W. Isen
*Attorney, Agent, or Firm*—Sughrue, Rothwell, Mion, Zinn and Macpeak

[57] ABSTRACT

An electronic musical box is disclosed in which a musical score can be readily stored and reproduced and the musical score can be easily changed to another. The musical box includes a pulse generator for generating a unitary pulse for a note whose duration is the shortest in the musical score and generating integer numbers of unitary pulses for other notes in the musical score. A tone pitch generating circuit generates tone pitch signals coded by a plurality of tone pitch switches so as to correspond to the tone pitches of the notes in the musical score. The coded tone pitch signals are stored in a memory, and a musical tone generating circuit reads data stored in the memory and generates musical tones.

9 Claims, 21 Drawing Figures

ELECTRONIC MUSICAL BOX

BACKGROUND OF THE INVENTION

This invention relates to an electronic musical box (organ) in which a musical score can be readily stored, reproduced and renewed by simple operation.

In a conventional musical box available on the market, a particular musical score is stored by mechanical means. Therefore, with such a musical box, it is possible to repeatedly play the same musical score, but it is impossible to change the musical score to another one.

A number of large scale electronic musical instruments in which ordinarily a memory means and an inputting keyboard are provided so that the musical notes stored in the memory means are read out to be produced as musical tones have already been proposed. One of such conventional electronic musical instruments is disclosed in U.S. Pat. No. 3,878,750. In this electronic musical instrument, one inputting keyboard is used, in time division manner, for tone pitch and for duration. Accordingly, only one keyboard is employed, and the size of the instrument may be reduced. However, it is still disadvantageous in that its operation is considerably intricate because the same keyboard is selectively used in association with the operation of switching means. Furthermore, the memory means must have a considerably large capacity because it should store tone pitches and tone durations in combination, and it is accordingly expensive.

SUMMARY OF THE INVENTION

Accordingly, an object of this invention is to eliminate the above-described difficulties. More specifically, an object of the invention is to provide an electronic musical box in which a musical score is readily stored and reproduced and it is possible to change the musical score to another with accuracy, even by a person not skilled in the art, and which is relatively low in cost.

DESCRIPTION OF THE PREFERRED EMBODIMENTS

Figure 1:
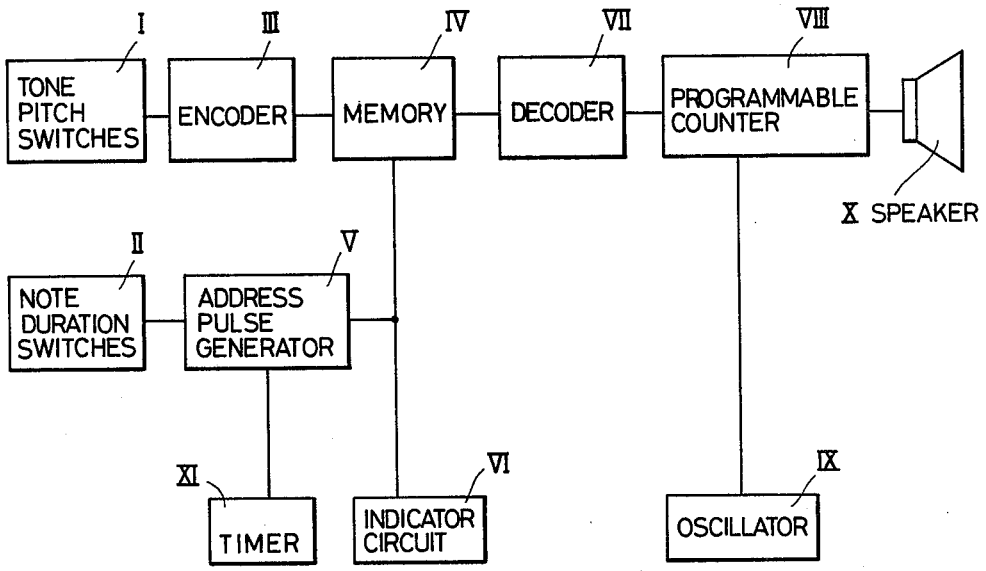
FIG. 1 is a block diagram showing the entire arrangement of the first embodiment of the invention.
Figure 2:
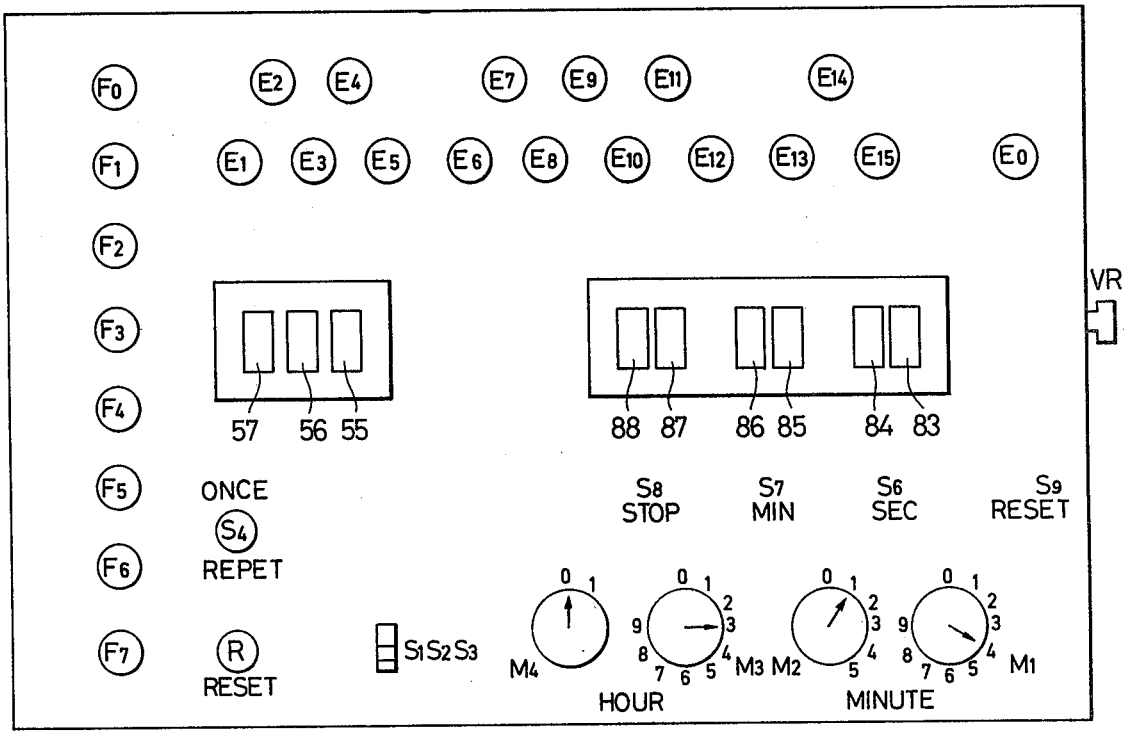
FIG. 2 is a plan view showing the panel of an electronic musical box according to the first embodiment of the invention.

FIG. 1 is a block diagram showing the arrangement of a first embodiment of the invention which includes a group I of at least thirteen tone pitch switches consisting of one switch corresponding to one rest, and twelve switches corresponding to tones different by a half tone in one octave. FIG. 2 shows a panel of a musical box which is formed according to the block diagram shown in FIG. 1. On the panel, there are provided a switch $E_0$ corresponding to a rest, and fifteen switches $E_1$ through $E_{15}$ (the number of which is more by three than the number of tones in one octave) corresponding to tones different by a half tone in tone pitch.

Referring back to FIG. 1, the musical box further includes a group II of note switches corresponding to the durations of notes. In this case, the duration of a note having the shortest duration such as for instance a sixteenth note is employed as a reference duration, and the duration of tone which is an integer multiple of the reference duration is stored in memory means. Furthermore, a punctuation switch $F_0$ is provided on the panel so that when two notes or more are continued in a music, they can be punctuated. When this switch is operated, in the memory means an address is occupied by a toneless signal indicating a punctuation. In other words, the punctuation switch provides a code which insures that the proper attack of the subsequently struck note will be made on replay. In FIG. 2, the note switches $F_1$ through $F_7$ cause the addresses of the memory means to be occupied with numbers which are integer multiples of that represented by the switch $F_0$.

Figure 3:
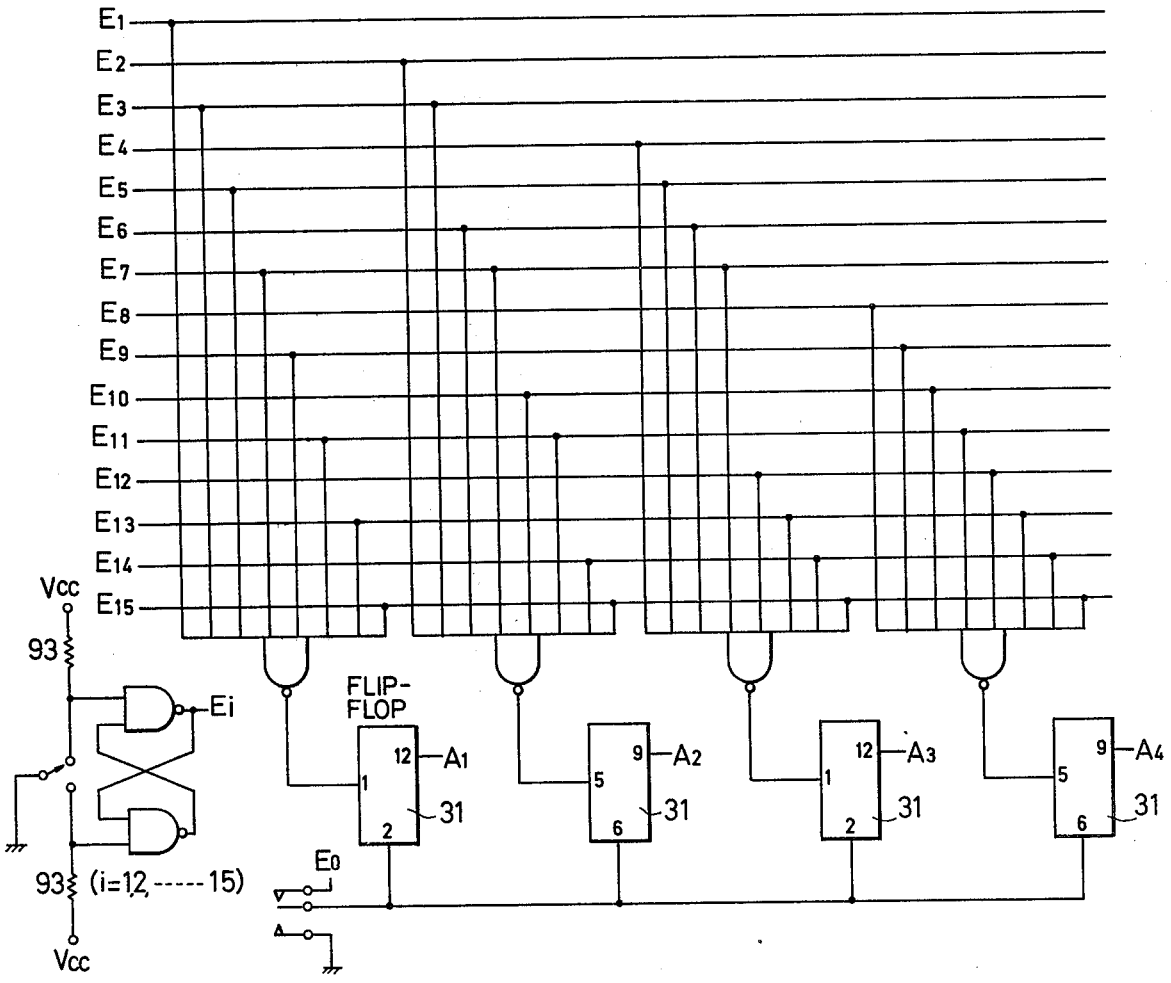
FIG. 3 is a logic circuit diagram of an encoder.

An encoder III receives signals provided by the operation of the tone pitch switches I and binary encodes these signals so that they can be readily and electronically stored. A specific circuit of the encoder III is shown in FIG. 3. When the switches $E_1$ through $E_{15}$ shown in FIG. 2 are selectively operated, binary outputs can be obtained. For instance, upon operation of the switch $E_1$, bits 1, 0, 0 and 0 are outputted through the terminals $A_1$, $A_2$, $A_3$ and $A_4$ of the encoder, and this output state is stored by flip-flop circuits 31 until the next tone pitch switch is operated. Thus, the flip-flop circuits 31 serve as memory elements for the tone pitch switches. A suitable example of the flip-flop circuit 31 is an integrated circuit produced by Texas Instruments Inc., whose part number is SN 7473. In addition, in FIG. 3, the cross-connected NAND gates represent an example of a suppression circuit for occurrences of chattering. Terminals $E_1$, $E_2$, etc. in the suppression circuit are connected respectively those in the circuit of the encoder III shown in FIG. 3.

Figure 4:
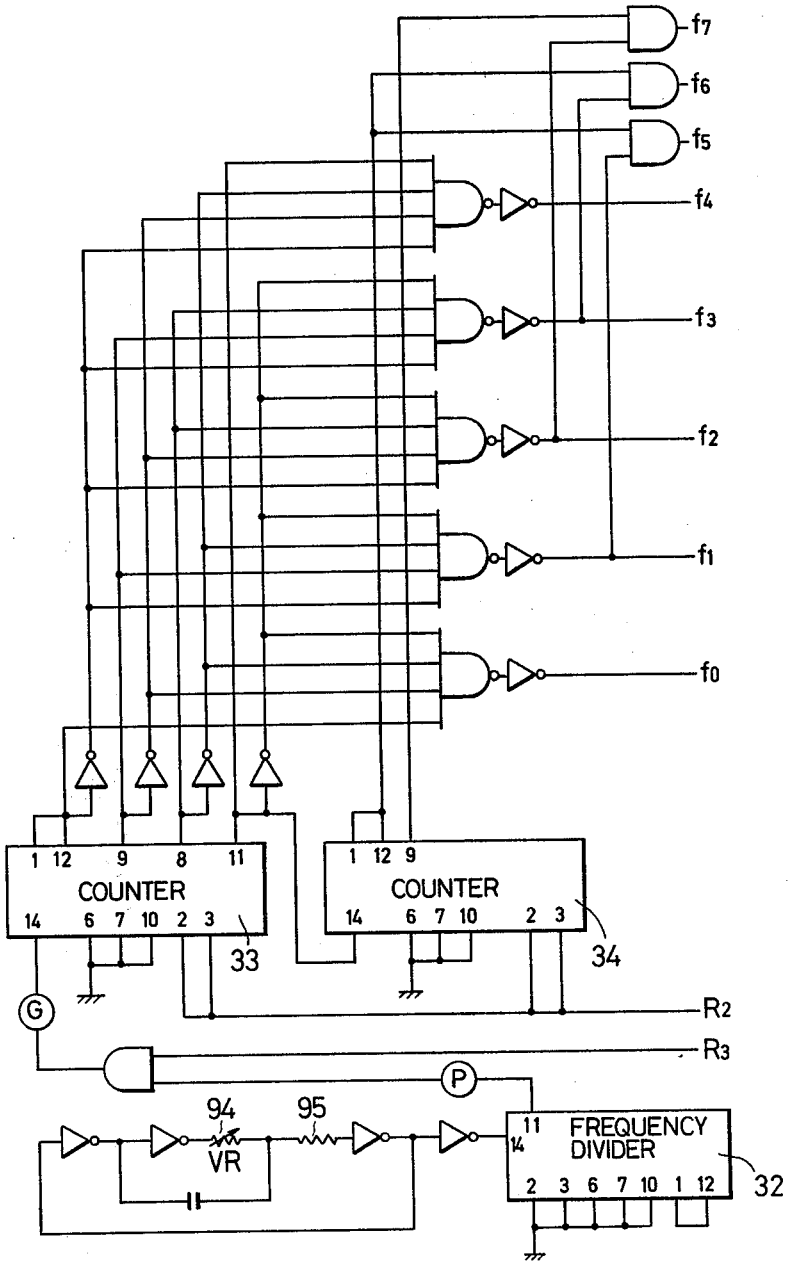
FIGS. 4 and 5 are two parts of a logic and integrated circuit diagram showing an address pulse generating circuit.
Figure 5:
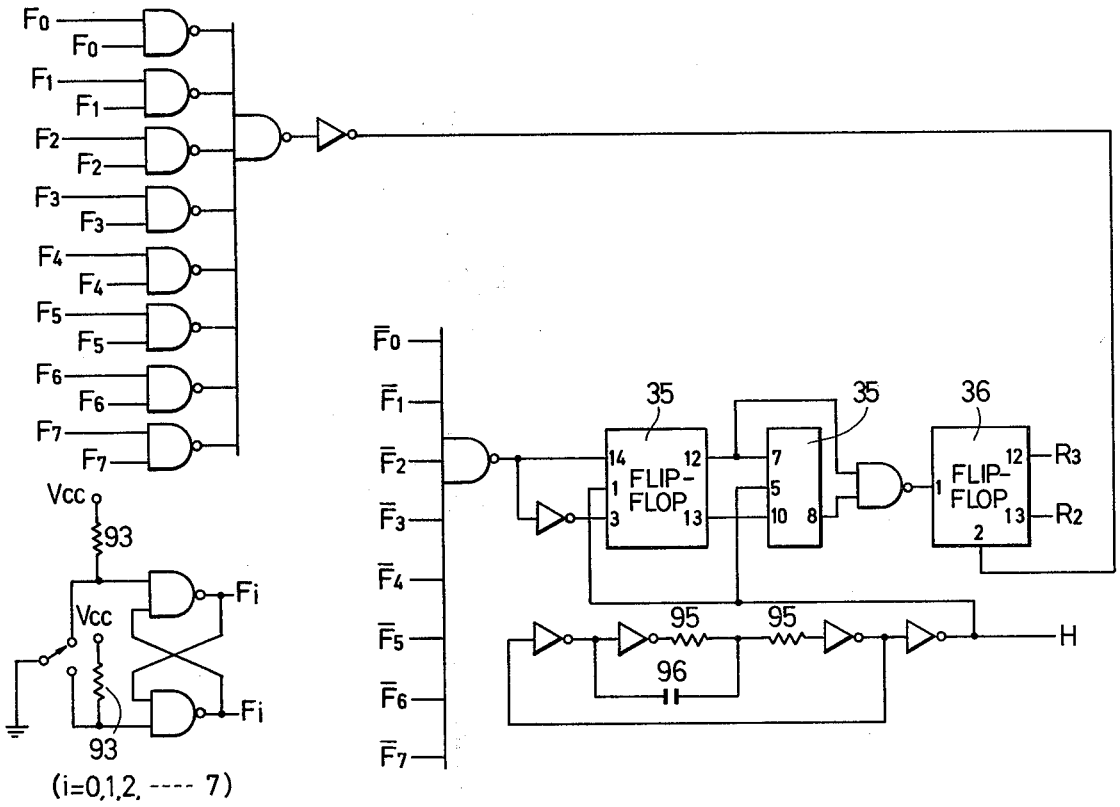
Figure 6:
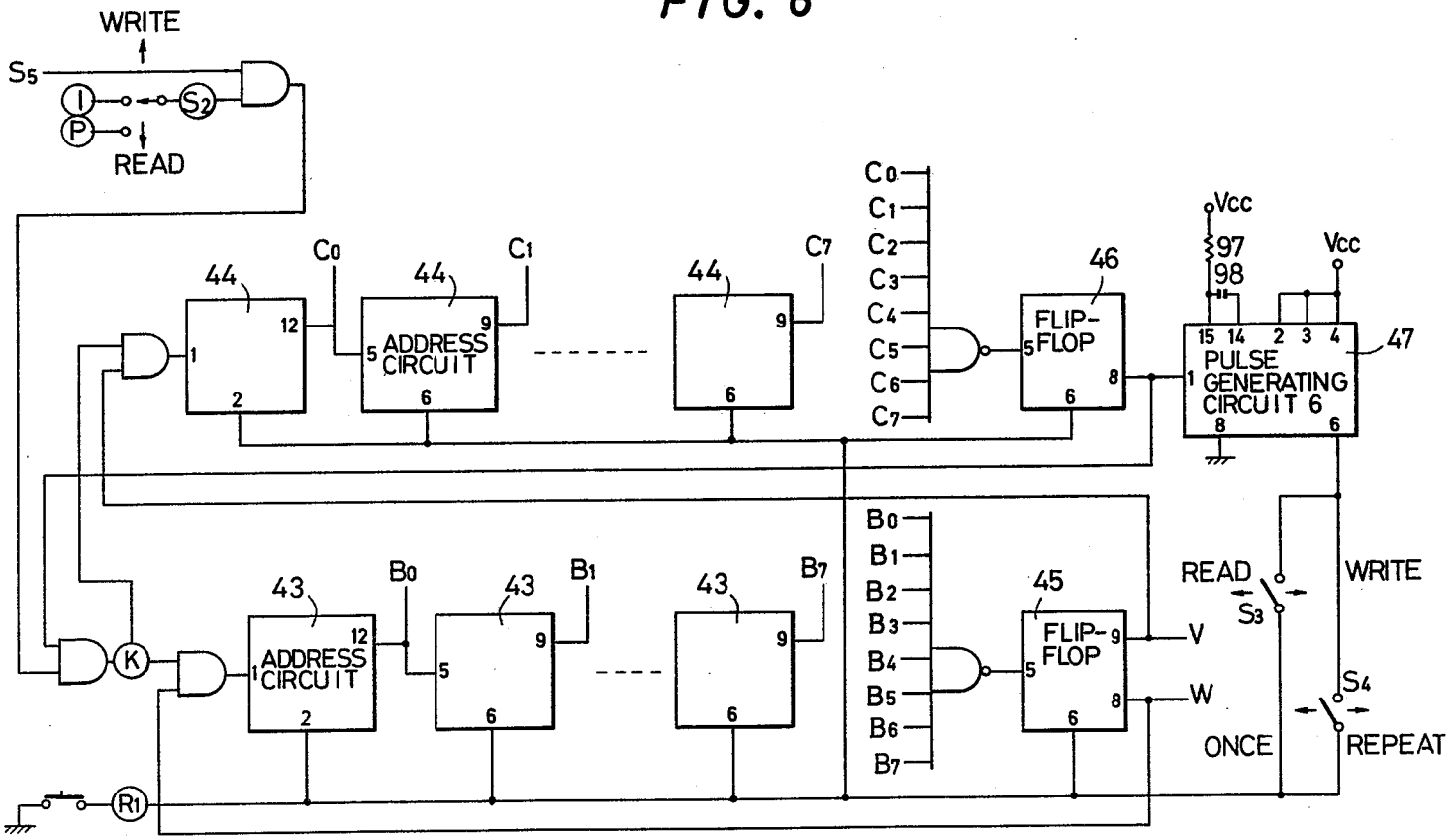
FIG. 6 is a logic and integrated circuit diagram illustrating an address circuit.

An address pulse generator V generates pulses in association with the operations of the above-described note switches. A specific circuit of the address pulse generator is shown in FIGS. 4 and 5. Terminals $f_1$, $f_2$, etc. and $R_2$ and $R_3$ in FIG. 4 are connected respectively those in FIG. 5. A pulse generating circuit for determining the tempo of a music is indicated in the lower part of FIG. 4. The pulse generating circuit comprises three inverter amplifiers connected in cascade with internal and external feedback loops. The output of the pulse generating circuit is subjected to frequency division in an frequency divider 32, the output of which is applied to counter circuits 33 and 34 through the output terminals P and G. Suitable examples of the frequency divider 32 and the counter circuits 33 and 34 are SN 7490A produced by Texas Instruments Inc. The counter circuit output produces one through 24 pulses in association with the operation of the switches $F_0$ through $F_7$ by the circuit shown in FIG. 5. More specifically, one, two, four, six, eight, twelve, sixteen and twenty-four pulses are produced by the operation of the switches $F_0$, $F_1$, $F_2$, $F_3$, $F_4$, $F_5$, $F_6$ and $F_7$, respectively, thereby operating an address circuit, a specific example of which is shown in FIG. 6. A monostable multivibrator consists of two flip-flop circuits 35, a NAND gate and an astable multivibrator comprising four inverters in series mode as shown in FIG. 5. A suitable example of the flip-flop circuits 35 is SN 7473 produced by Texas Instruments Inc. Designated by reference numeral 36 is a flip-flop circuit to which the outputs of the monostable multivibrator and the counter circuits 33 and 34 are applied thereby producing two output pulse signals contrary to each other through the two output terminals of the flip-flop circuit 36. The output pulse signals are produced by the operation of the flip-flop circuit 36, when the output signal of the monostable multivibrator is applied thereto and the output pulse signals are prevented from being produced when the output signals of the counter circuits 33 and 34 are applied thereto. An suitable example of the flip-flop circuit 36 is SN 7473 produced by Texas Instruments Inc. In addition, in FIG. 5, the cross-connected NAND gates represent an example of a suppression circuit for occurrences of chattering. Terminals $F_0$, $F_1$, etc. and $\overline{F_0}$, $\overline{F_1}$, etc. in the suppression circuit are connected respectively those in the address pulse generating circuit shown in FIG. 5. The address circuit is so designed that when a plurality of memories are provided in a memory means IV, they can be used in a series mode. That is, the last code in the first address circuit 43 is introduced into a gate circuit thereby operating the next address circuit 44. Then, the last code in the address circuit 44 is introduced through a gate to a single pulse generating circuit 47. When the single output pulse of the circuit 47 is applied to the address circuit 43 through the closed path (repetition side) of a repetition switch $S_4$, two memory circuits carry out the circulation operation, as a result of which the same music is repeatedly played in association with the memory reading operation. Suitable examples of the address circuits 43 and 44 are SN 7473 produced by Texas Instruments Inc., respectively, and a suitable example of the single pulse generating circuit 47 is SN 74123 produced by Texas Instruments Inc. A flip-flop circuit 46 is to control the memory reading operation in accordance with the operations of the switches $S_3$ and $S_4$. A suitable example of the flip-flop circuit 46 is SN 7473 produced by Texas Instruments Inc. Reference characters $B_0$ through $B_7$ and $C_0$ through $C_7$ in FIG. 6 designate the output terminals of the address circuits, which are connected to the memory means.

Figure 7:
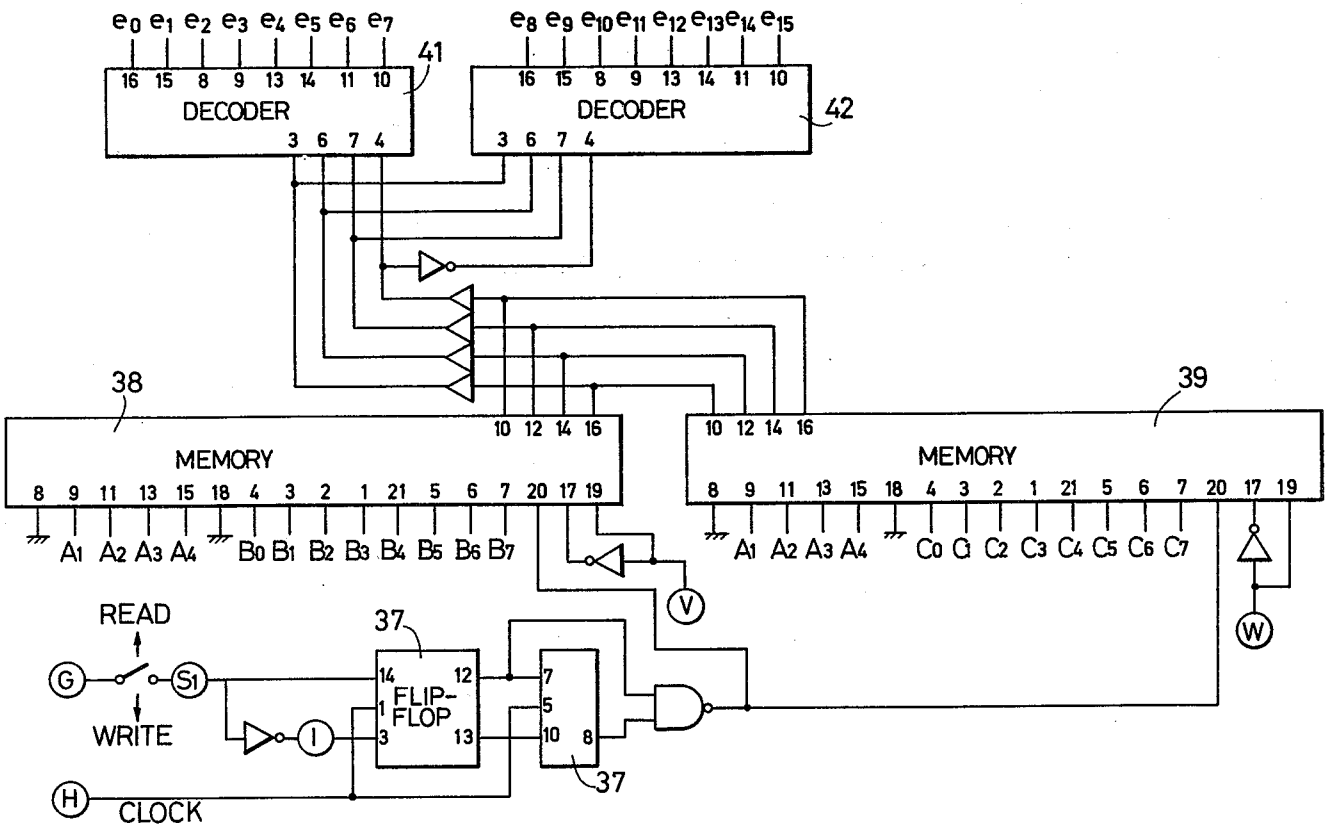
FIG. 7 is a logic and integrated circuit diagram showing a memory means.
Figure 8:
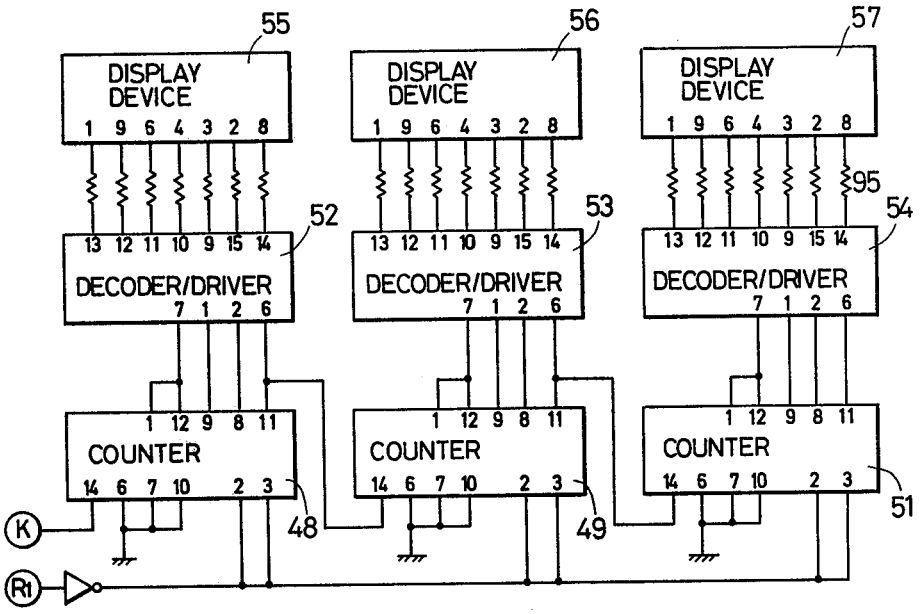
FIG. 8 is an integrated circuit diagram showing an indicator circuit.

Referring back to FIG. 1, signals obtained by operating the tone pitch switches and the tone switches are stored in memory means IV. More specifically, as shown in FIG. 7, a monostable multivibrator consists of flip-flop circuits 37, a NAND gate and the astable multivibrator shown in FIG. 5, and address circuit V is formed so that two memories 38 and 39 can be used in a series mode. A suitable example of the flip-flop circuit 37 is SN 7473 produced by Texas Instruments Inc., and suitable examples of the two memories 38 and 39 are P 2101A produced by Intel Corp., respectively. A flip-flop circuit 45 shown in FIG. 6 is to switch the address signal into the memory 39, when the memory 38 is fully occupied with information. A suitable example of the flip-flop circuit 45 is SN 7473 produced by Texas Instruments Inc. In FIG. 7, reference character H designates a clock pulse output terminal, I an address circuit input terminal, and V and W memory control terminals, which are connected to terminals having the same reference characters in other drawings. Decoders 41 and 42 are BCD-to-decimal decoders wherein the binary encoded output of the two memories 38 and 39 are converted into decimal data, respectively. Suitable examples of the decoders 38 and 39 are SN 74141 produced by Texas Instruments Inc., respectively. An indicator circuit VI counts and displays pulses applied to the address circuit in order to indicate an address for the operation of the memory means IV. A specific example of the indicator circuit is shown in FIG. 8, in which reference characters K and $R_1$ designate the input terminal to the indicator circuit and a reset switch, respectively. Decimal counters 48, 49 and 51 form a three-decade counter for indicating the address signals. Suitable examples of the decimal counters 48, 49 and 51 are SN 7490A produced by Texas Instruments Inc., respectively. Reference numerals 52, 53 and 54 designate BCD-to-seven segment decoders/drivers in which the outputs of the decimal counters 48, 49 and 51 are converted into the signals for seven segment numeric display, respectively. Examples of the suitable seven segment decoders/drivers 52, 53 and 54 are SN 7447A produced by Texas Instruments Inc., respectively. In addition, reference numerals 55, 56 and 57 designate seven segment numeric display device, respectively. A suitable example of the respective devices is TLR 303 produced by Tokyo Shibaura Electric Co., Ltd.

Figure 9:
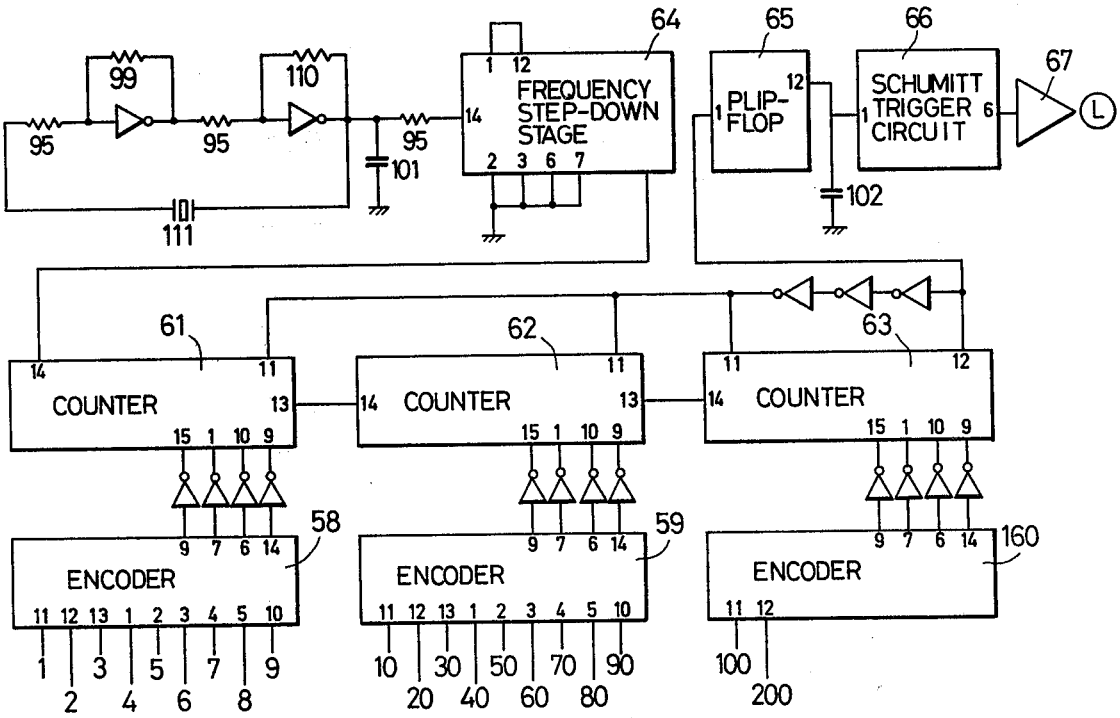
FIG. 9 is an integrated circuit diagram showing a scale frequency generating circuit.
Figure 10:
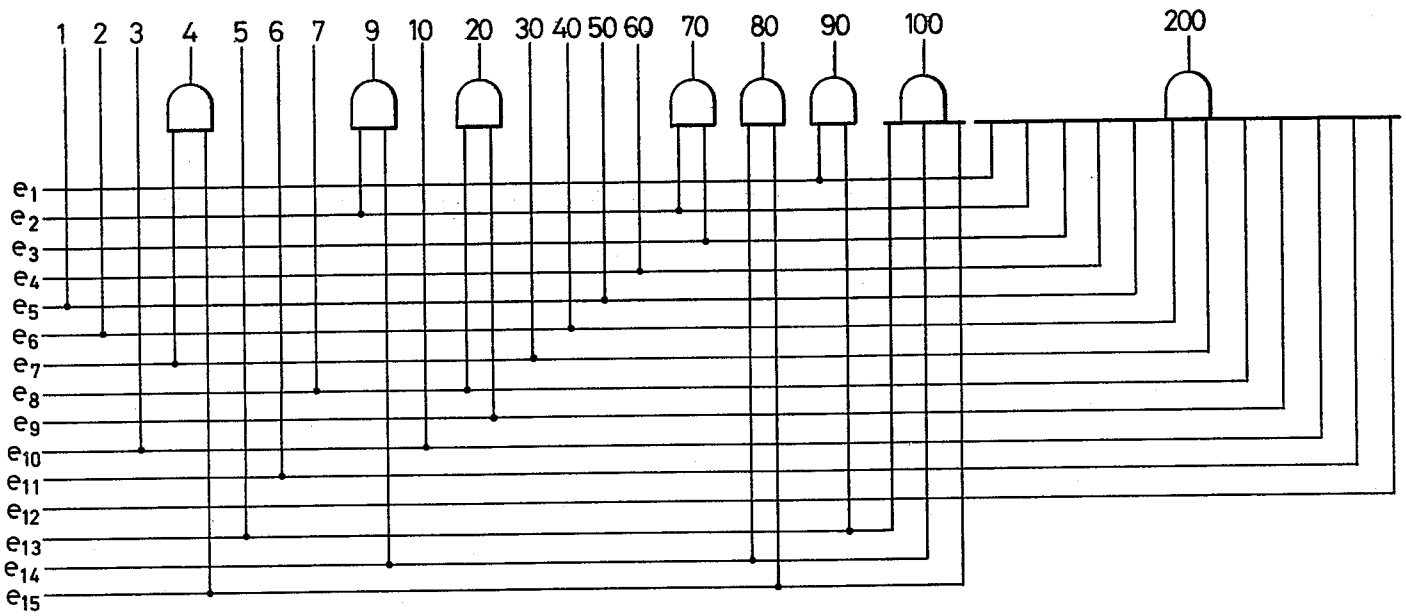
FIG. 10 is a logic circuit diagram showing a scale frequency code circuit.

A decoder circuit VII converts the output of memory means IV into analog data. In order to obtain a code for determining the frequency division ratio of a programmable counter VIII, a scale frequency coding circuit shown in FIG. 10 is provided. For instance, $e_1$ is a value obtained by decoding the memory output in correspondence to the switch $E_1$, by which an output "290" is obtained in the coding circuit, and when the output "290" is applied to a scale frequency generating circuit shown in FIG. 9, a predetermined frequency division ratio is obtained. Designated by reference numerals 58, 59 and 160 are 10-line decimal to 4-line BCD encoders, respectively, wherein 10-line decimal numbers are converted into BCD. A suitable example of the respective encoders 58, 59 and 160 is SN 74147 produced by Texas Instruments Inc. Reference numerals 61 through 63 designate up-down counters for frequency division used as a programmable counter. A suitable example of the respective counters 61 through 63 is SN 74190 produced by Texas Instruments Inc. Reference numeral 65 designates a flip-flop circuit for frequency division of which a suitable example is SN 7473 produced by Texas Instruments Inc. Furthermore, reference numeral 66 designate a schmitt-trigger circuit of which a suitable example is SN 7413 produced by Texas Instruments Inc. An oscillator which is, for instance, a quartz oscillator (111 in FIG. 9) of 1 MHz, provides an output to a frequency step-down stage 64 shown in FIG. 9 for decreasing the oscillation frequency to 100 KHz is provided so as to facilitate the operation of the programmable counter. A suitable example of the frequency step-down stage 64 is SN 7490A produced by Texas Instruments Inc. In FIG. 9, reference character L designates a terminal for a musical tone output obtained by subjecting the frequency 100 KHz to frequency division. A loudspeaker X is connected to the output of programmable counter VIII.

Figure 11:
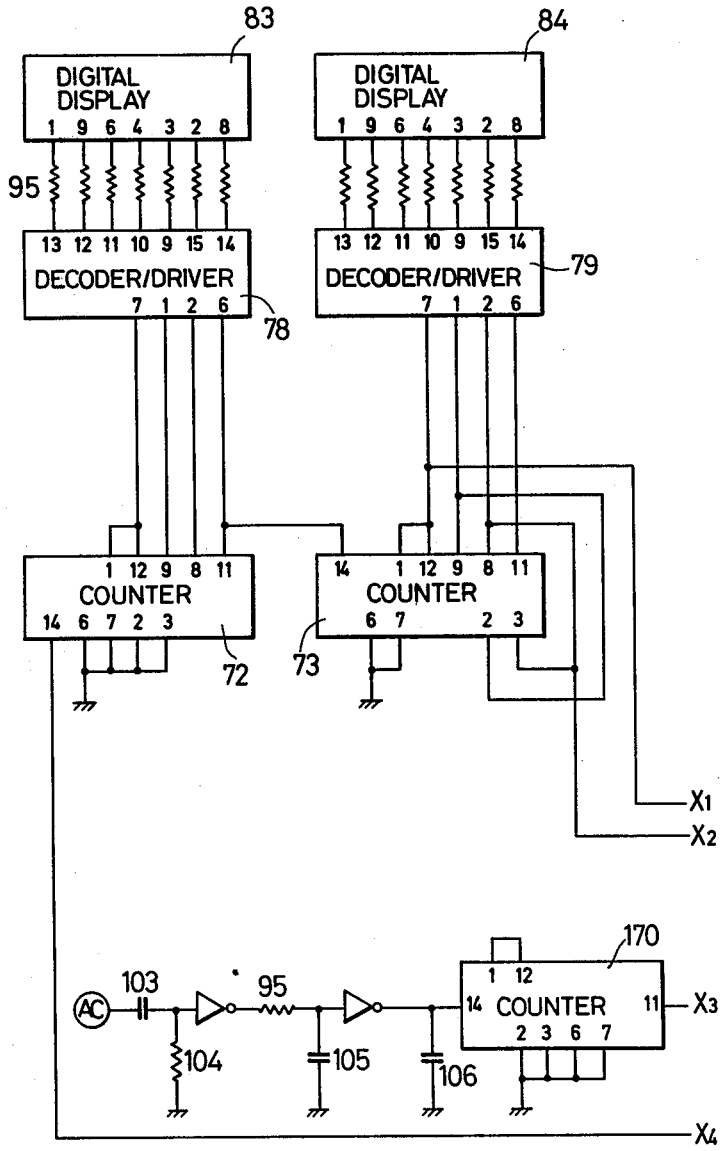
FIGS. 11 through 13 are three parts of a logic and integrated circuit diagram showing a clock circuit section.
Figure 12:
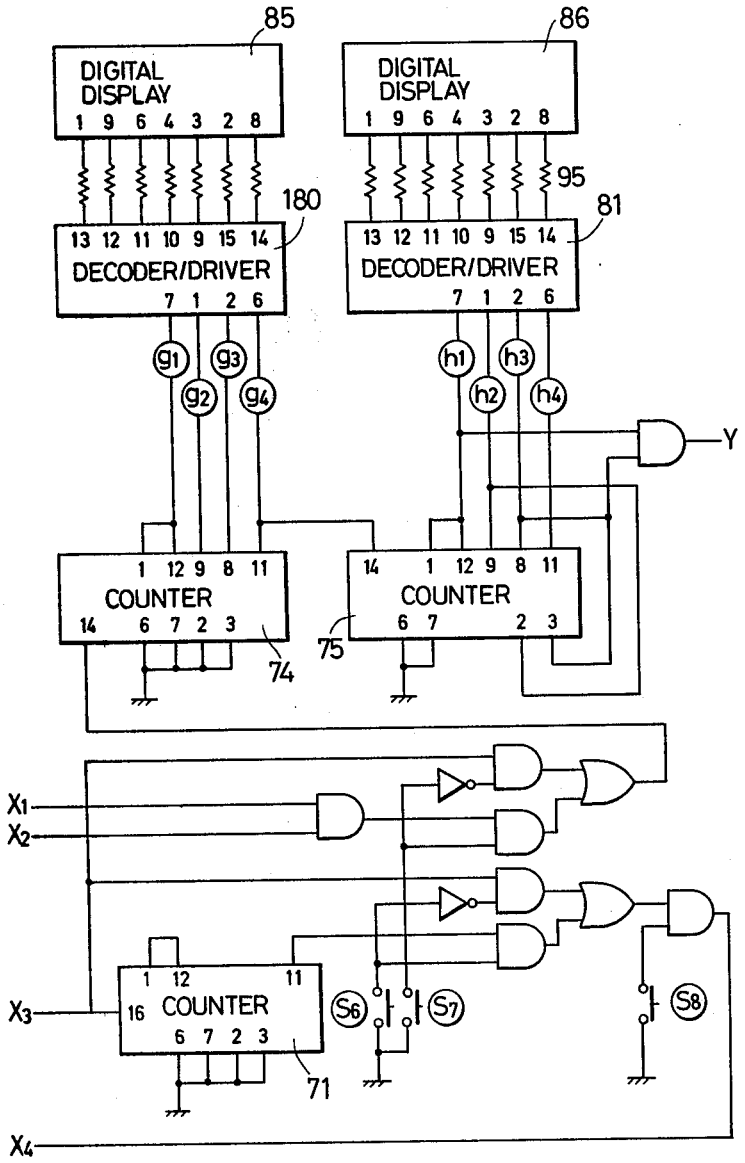
Figure 13:
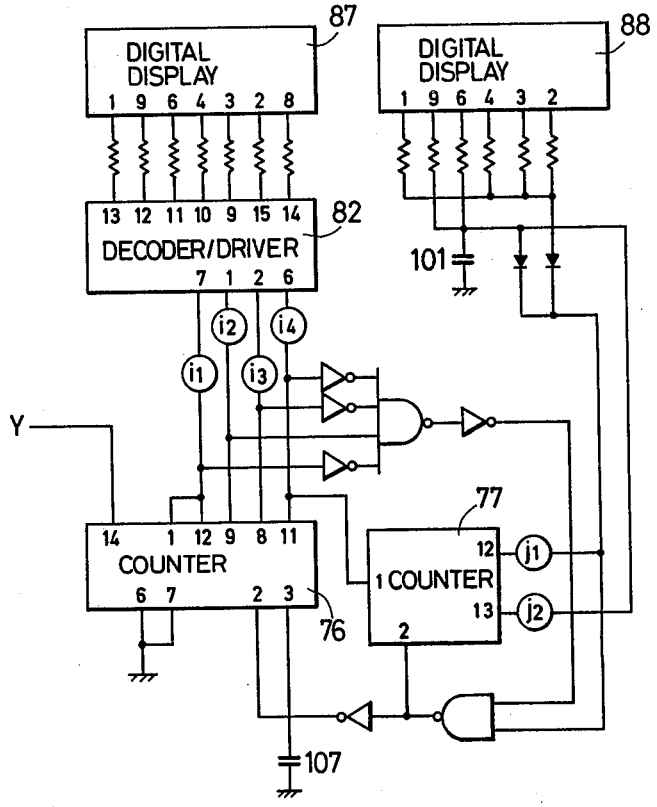
Figure 15:
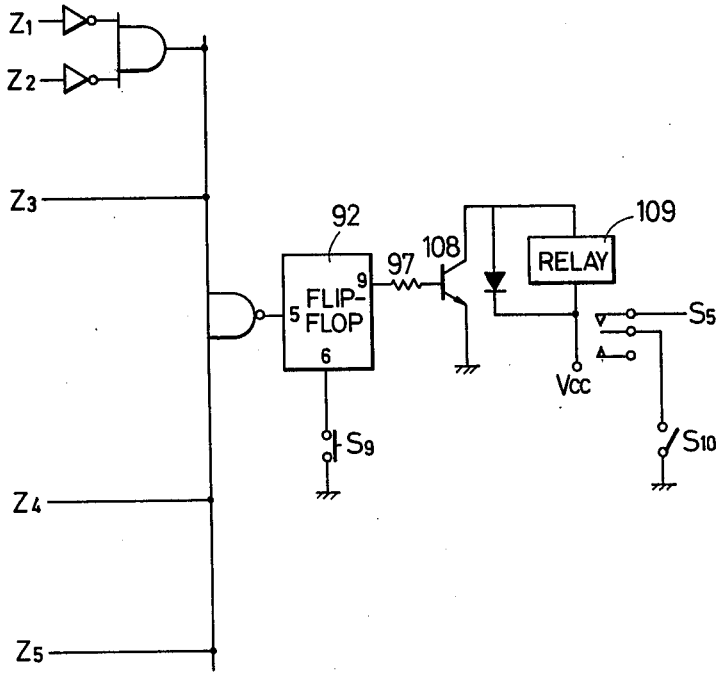
FIGS. 14 and 15 are two parts of a logic and integrated circuit diagram showing a timer circuit section.
Figure 14:
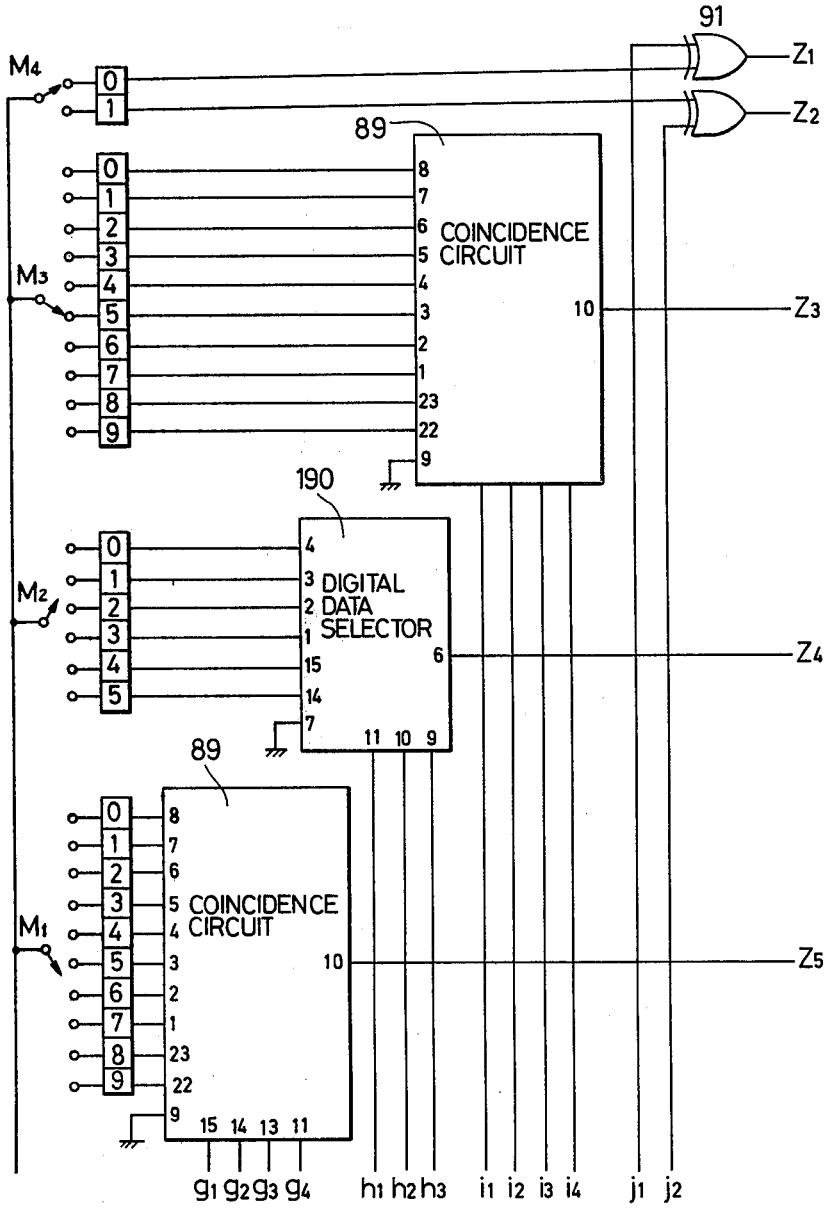

The timer means XI comprises a clock circuit section and a timer circuit section. The clock circuit section is concretely shown in FIGS. 11 through 13. The commercial power source frequency 50 Hz is frequency-divided to 1 Hz, which is counted by counter circuits 72 through 77, and "hours", "minutes" and "seconds" are displayed on the digital display units 83 through 88. Suitable examples of the counter circuits 72 through 77 are SN 7490A produced by Texas Instruments Inc., respectively. In addition, suitable examples of the digital display units 83 through 88 are light emitting diode display devices produced by Tokyo Shibaura Electric Co., Ltd, whose part numbers are TLR 303, respectively. Reference numerals 78, 79, 180, 81 and 82 designate BCD-to-seven segment decoders/drivers wherein the respective outputs of the counters 72 through 76 which form a counter circuit in combination with the flip-flop circuit 77, are converted into the signal for seven segment numeric display. Examples of the suitable decoders/drivers 78, 79, 180, 81 and 82 are SN 7447A produced by Texas Instruments Inc., respectively. Furthermore, reference numerals 170 and 171 designate decimal counters for the commercial power source frequency division. A suitable example of the respective decimal counters 170 and 71 is SN 7490 produced by Texas Instruments Inc. In FIG. 12, reference characters $S_6$, $S_7$ and $S_8$ designate switches for second speed feeding, minute speed feeding and stop, respectively. Furthermore, reference characters $X_1$ through $X_4$ designate connection points with those in FIG. 11. The time circuit section is shown in FIGS. 14 and 15. A desired time is set by means of rotary switches $M_1$ and $M_4$, and is compared with the output of the clock circuit section in coincidence circuits 89, 89 and 190. Suitable examples of the coincidence circuits 89 and 190 are SN 74150 and SN 74151A produced by Texas Instruments Inc., respectively. Reference numeral 92 shown in FIG. 15 designates a flip-flop circuit in which its output state is stored unitl the output is inverted by the input trigger and the input is reset. A suitable example of the flip-flop circuit 92 is SN 7473 produced by Texas Instruments Inc. The comparison result is applied through a relay 109 and through a terminal $S_5$ to the address circuit input gate in FIG. 6, as a result of which the electronic musical box can be operated at the time instant set by the time circuit section. A switch $S_{10}$ is maintained closed when the musical box and the clock are operated in association with each other, but it is maintained open when only the musical box is used. A switch $S_9$ is employed to reset the timer circuit section.

The operation of the electronic musical box according to the invention will be described with reference to the case where a part of a music, a Doh tone (C) fourth note, a Doh tone fourth note, and a half rest are stored.

Referring to FIG. 2, the WRITE-READ switches $S_1$, $S_2$ and $S_3$ are switched to the WRITE side. Thereafter, the tone pitch switch $E_1$ corresponding to the Doh tone and the note switch $F_4$ corresponding to the fourth note are depressed. Since the number of address pulses for the note switch $F_4$ is eight, the code "1 0 0 0" of the switch $E_1$ is stored with respect to eight addresses. In this case, if the input to the memory means IV is obtained at the output of the memory means simultaneously, decoded, and frequency-divided by the counter means, then the tone having a tone pitch corresponding to the tone pitch switch can be obtained immediately. Thus, the operation is correctly performed as if a piano is played. As the next tone is the same Doh tone, punctuation is necessary. Therefore, a toneless signal is applied to the next address by depressing the note switch $F_0$ once. Thereafter, the switches $E_1$ and $F_4$ are depressed again, and then the switch $E_0$ for a rest and the note switch $F_6$ (corresponding to the duration of a half note) are depressed to perform the storage operation. Upon depression of the note switch, the indicator circuit is also operated, and the display is changed to indicate addresses used. Therefore, the next tone pitch switch should be depressed after it is confirmed from the display that the digital variation is stopped. Normally, the tone pitch switch and the note switch are operated using both hands. However, if the circuit of the tone pitch switch is provided with a memory element 31 (FIG. 3), these switches can be alternately operated with a single hand because the note switch may be operated immediately after the operation of the tone pitch switch.

In producing a musical score, the aforementioned WRITE-READ switch assembly is switched to the READ side to generate the address pulses, as a result of which the written music is read out of the memory means, and tones through the programmable counter VIII can be produced through the loudspeaker X. In this case, if the ONCE-REPEAT switch $S_4$ is closed, the same music can be repeatedly produced.

When it is required to produce the music at a desired time instant, the timer means XI is operated. That is, if the timer circuit section in the timer means XI is set to the desired time and then the switch $S_{10}$ is closed, then the musical box is operated at that time. Thus, if the electronic musical box according to the invention stores a desired musical score before the user goes to bed, it will work as an alarm clock when he gets up the next morning. Furthermore, it may be used as a timer indicating the start and finish of various operations. As it is possible to set the timer means to a correct time, the timer means can be operated in association with a radio set or a television set by additionally providing a relay means. Before the music in the musical box is changed, all the contents of the memory means should be eliminated by turning off the power switch.

Figure 16:
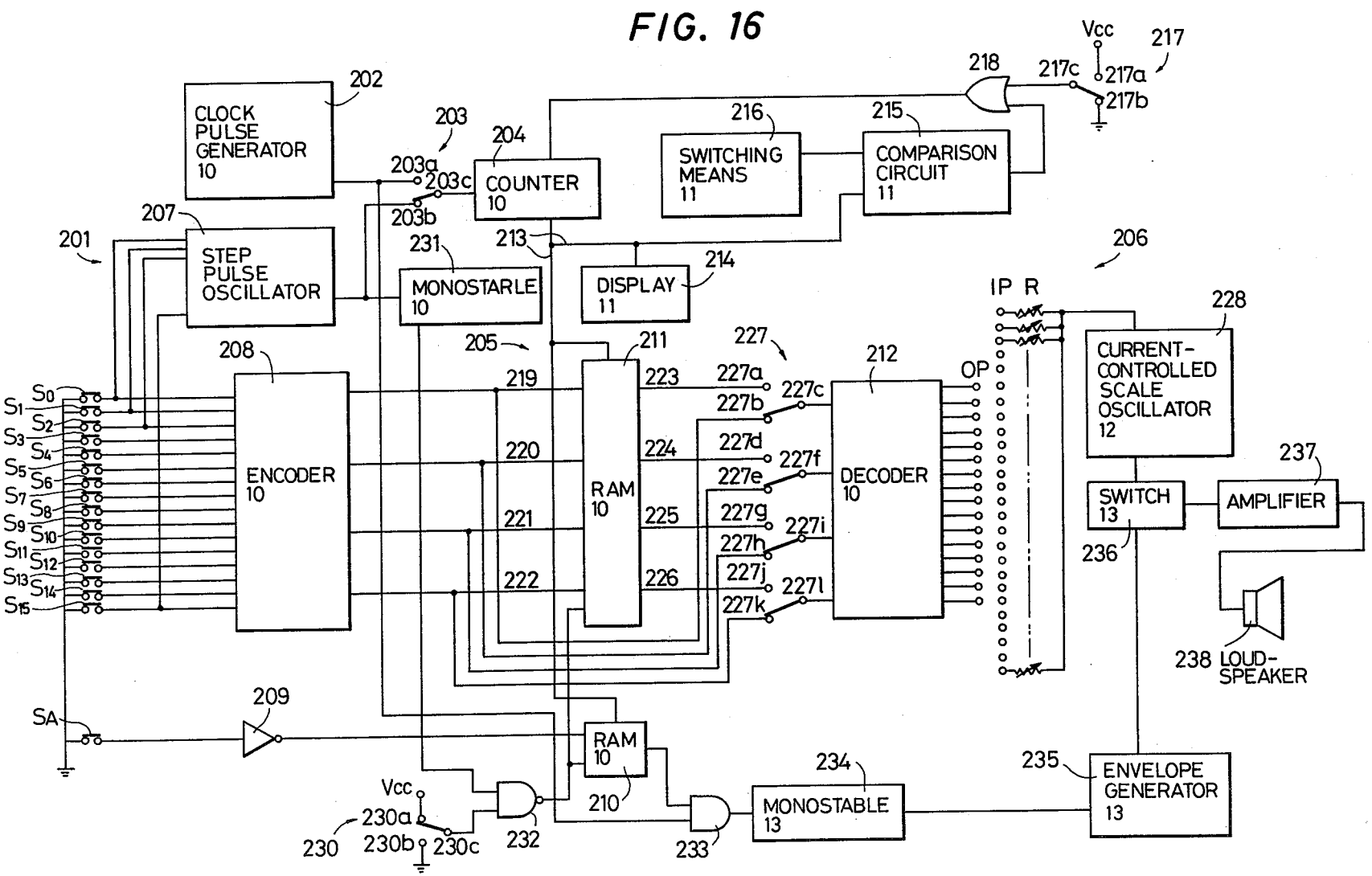
FIG. 16 is a block diagram showing the entire arrangement of the second embodiment.

Shown in FIG. 16 is a block diagram illustrating a second embodiment of this invention, the specific feature of which resides in that such note switches as those shown in FIG. 1 are not employed, but the durations of notes are stored by the operations of tone pitch switches, and after the output of the memory means is decoded, connecting cords are employed for connection of a musical tone signal generator.

In FIG. 16, a signal input means 201 comprises tone pitch switch S0, S1, S2 . . . S15, a tone punctuation switch SA, and a step pulse generator 207. A suitable example of the step pulse generator 207 is SN 74121 produced by Texas Instruments Inc. Each of the switches S0 through S15 and SA is a restoring type push button switch in which two values "on" and "off" are switched. One of the contacts of these switches are grounded, but the other contacts are connected to an encoder 208 and the step pulse generator 207. A suitable example of the encoder 208 is SN 74148 produced by Texas Instruments Inc.

The switch S0 is used for a rest. One contact of the switch SA is connected to an inverter 209, which is connected to the data input terminal of a random access memory 210 of 1-bit x 256 words. A suitable example of the random access memory 210 is P 2101A produced by Intel Corp. A Clock pulse generator 202 generates a pulse signal having a certain period which can be adjusted by a variable resistor or the like. Typically, the clock pulse generator 202 is an astable multivibrator which is composed of SN 7473 and SN 74132 produced by Texas Instruments Inc. The encoder 208 encodes sixteen different signals into 4-bit binary codes. The memory means 205 comprises a random access memory 211 of 4-bit×256 words as its main element. A suitable example of the random access memory 211 is P 2101A produced by Intel Corp. A decoder 212 operates to decode a 4-bit memory output code, thereby providing sixteen different signals. A suitable example of the decoder 212 is SN 74154 produced by Texas Instruments Inc.

A switch 203 comprises a contact 203*a* connected to the clock pulse generator 202, a contact 203*b* connected to the step pulse generator 207, and a switching contact 203*c* for switching the contacts 203*a* and 203*b*. The switching contact 203*c* is connected to a counter 204 a suitable example of which is SN 7493A produced by Texas Instruments Inc.

The step pulse generator 207 operates to generate pulses adapted to operate the counter 204 and a monostable multivibrator 231. A suitable example of the monostable multivibrator 231 is SN 74121 produced by Texas Instruments Inc. The counter 204 is a binary counter in which binary eight-bit count signals are repeatedly outputted to a single line 213 which is connected to the address input terminals of memories 210 and 211, to a display means 214 for displaying the counting state of the counter 204, and to one input of a comparison circuit 215, to the other input of which a switching means 216 is connected.

Figure 18:
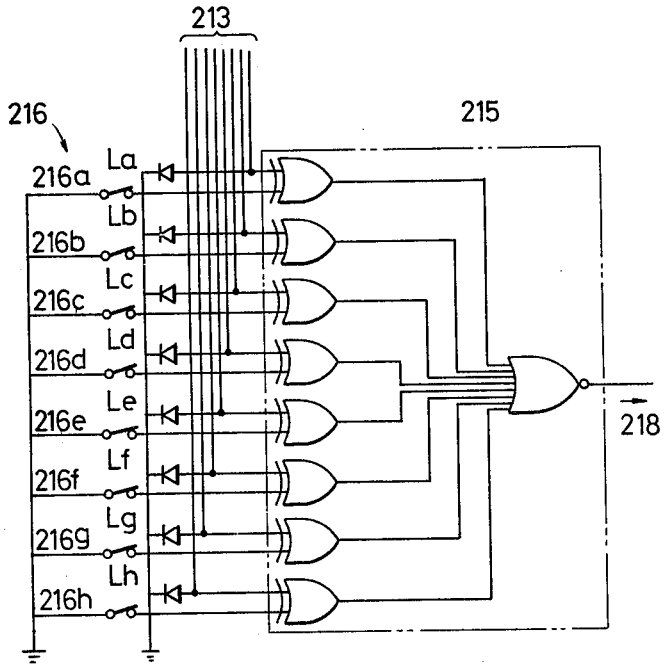
FIG. 18 is a logic circuit diagram showing a comparison circuit and a switching means.
Figure 19:
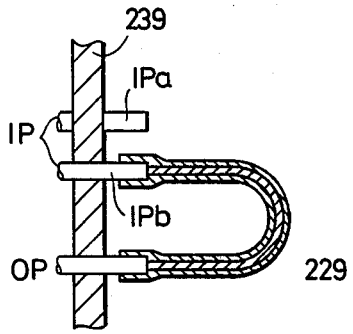
FIG. 19 is a cross-sectional view showing an output terminal and input terminals provided on the operating panel.

The display means 214 and the switching means 216 are shown in FIG. 18 in more detail. The display means 214 comprises eight light emission diodes, or display lamps La through Lh which are connected to one input of respective EXCLUSIVE OR gates in the comparison circuit 215. The other inputs of the EXCLUSIVE OR gates are connected to one contact of switches 216*a* through 216*h* forming the switching means 216. The display lamps La through Lh are connected to lines 213. Therefore, the count signal from the counter 204 is displayed by the lighting of the display lamps La through Lh which are provided in correspondence to the switches 216*a* through 216*h* (FIG. 19).

The outputs of the EXCLUSIVE OR gates are applied to NOR gate in the comparison circuit 215, the output of which is applied to an OR gate 218. A contact 217*a* of a switch 217 for resetting the counter 204 is connected to a terminal for supplying a high logic level "H", and a movable contact 217*c* for switching the contact 217*a* and the grounded contact 217*b* is connected to the other input of the OR gate 218. The output of the OR gate 218 is connected to the respective reset terminals in the counter 204.

The encoder 208 is connected through lines 219 and 220 to the memory 211, the output lines 223 through 226 of which are connected respectively to contacts 227*a*, 227*d*, 227*g* and 227*j* of a switching of a switching means 227. Lines 219 through 222 are branched to be connected to contacts 227*b*, 227*e*, 227*h* and 227*k* of the switching means 227. The contacts 227*a* and 227*b*, the contacts 227*d* and 227*e*, the contacts 227*g* and 227*h*, and the contacts 227*j* and 227*k* are switched by movable contacts 227*c*, 227*f*, 227*i* and 227*l*, respectively, which are connected to the inputs of the decoder 212. These movable contacts 227*c*, 227*f*, 227*i* and 227*l* are operated as one unit, that is, they are operated simultaneously.

At the output side of the decoder 212 there are provided sixteen output pins OP which are output terminals corresponding to the switches S0 through S15, and twenty-six input pins IP which are input terminals the number of which is larger than the number of the output pins OP. The input pins IP are arranged in two lines, one of which is formed by a group of input pins IPa corresponding to black keys in the piano, and the other is formed by a group of input pins IPb corresponding to white keys. It is preferable to display notes on the operating panel 239 respectively for the input pins IP. Furthermore, the output pins OP are arranged in one line below the input pins IP, and it is also preferable to display the same numbers as those of the switches S0 through S15, respectively, for the output pins OP. Flexible cords 229 shown in FIG. 19 are connected to the output pin so that the output pins OP can be selectively connected to the input pins IP. However, it should be noted that no flexible cord 229 is connected to the output pin OP corresponding to the switch S0 because it is used for a rest. A tone generator 206 comprises resistors R connected to the input pins IP for adjusting the tone pitches, the resistors R being further connected to a current-controlled scale oscillator 228.

A switch 230 is a reading and writing change-over switch for the memories 210 and 211. A contact 230*a* of the switch 230 is connected to the terminal supplying the logical "H" level, and a movable contact 230*c* for switching the contact 230*a* and a grounded contact 230*b* is connected to one input of a NAND gate 232. The output of the monostable multivibrator 231 connected to the step pulse oscillator 207 is applied to the other input of the NAND gate, the output of which is applied to the reading and writing input terminals of the memories 210 and 211.

Figure 17:
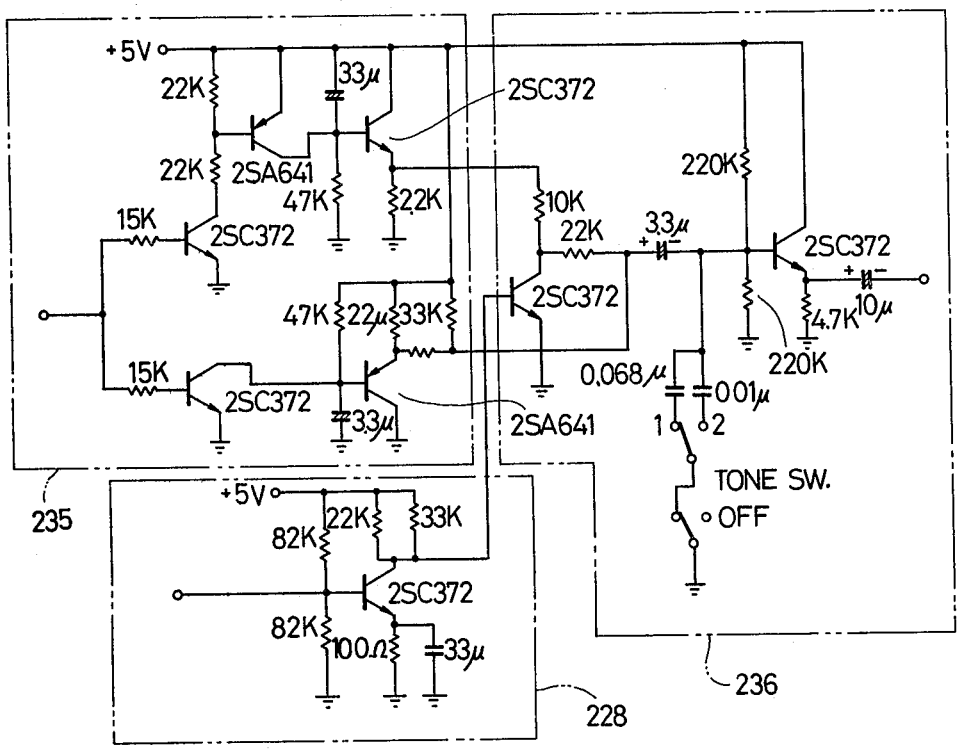
FIG. 17 is an electric circuit diagram showing a current-controlled scalled oscillator, an envelope generator and a switch.

The output of the memory 210 is applied to one input of an AND gate 233, to the other input of which is applied with the output of the clock pulse generator 202. The AND gate 233 is connected to a monostable multivibrator 234 to which an envelope generator 235 is connected. In this case, a suitable example of the monostable multivibrator 234 is Ser. No. 74121 produced by Texas Instruments Inc. A switch 236 connecting the scale oscillator 228 and the envelope generator 235 operates to combine the output of the scale oscillator 228 and the output of the envelope generator 235. As to the current-controlled scale oscillator 228, the envelope generator 235 and the switch 236, since integrated circuits are not used therefor, the specific circuits are shown in FIG. 17. In FIG. 16, reference characters 237 and 238 designate an amplifier and a loudspeaker, respectively.

Figure 20:
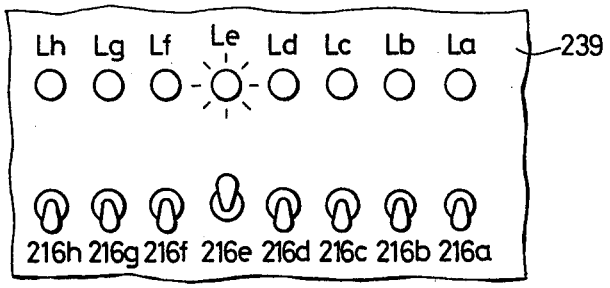
FIG. 20 is a fragmentary plan view showing the display lamps of the comparison circuit and the switches of the switching means mounted on the operating panel.

The operation of the circuit shown in FIGS. 16 and 18 will be described with reference to FIGS. 19 through 21.

In order that the memories 210 and 211 are placed in the reading state and the pulse signal from the step pulse generator 227 is applied to the counter 204, the movable contacts 230*c* and 203*c* of the switches 230 and 203 are set as shown in FIG. 16. Furthermore, in order that the switches 216*a* through 216*h* in the switching means 216 has the last address "256" of the memories 210 and 211, all of the switches are opened; more specifically, the levers of the switches are moved upward as viewed in FIG. 20.

If the movable contact 217*c* of the switch 217 is tripped from the contact 217*a* to the contact 217*b* to apply the low logic level "L" to OR gate 218, then the counter 204 is readied for starting its counting operation.

Figure 21:
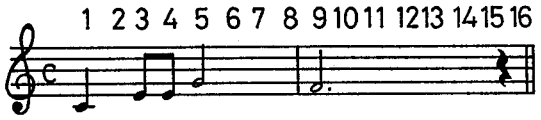
FIG. 21 shows a musical score for a description of the operation of the circuit shown in FIG. 16.

A musical score consisting of musical notes as shown in FIG. 21 is digitally encoded by encoder 208 and stored in the memory means 211, and the digital data thus stored are successively read out and converted into audio signals. In this case, the music consists of four notes Doh (C), Mi (E), Fa (F) and Soh (G), and therefore the cords 229 of the output pins corresponding to the numerical displays "1", "2", "3" "4" in the order of tone pitch are connected to the input pins IP corresponding to the displays "Doh", "Mi", "Fa" and "Soh", respectively. Since the numerals corresponding to the output pins OP are in correspondence to the numerals applied to the switches S1 through S4, the "Doh", "Mi", "Fa" and "Soh" musical tone signals can be applied to the output pins OP by operating the switches S1 through S4.

The note having the shortest duration in the music is an eighth note. Therefore, in order to input the first fourth note "Doh", the switch S1 is operated while the switch SA is operated, and then the switch SA is released, and the switch S1 is depressed again. That is, upon depression of the switch SA, the signal "L" applied to the inverter 209 is inverted into the signal "H", which is applied to the data input terminal of the memory 210. Upon depression of the switch S1, the binary number "1" is applied to the line 219 through 222, while one of the inputs of the step pulse generator 207 is lowered to the "L" from the "H". Therefore, the level of the output of the step pulse generator is raised to the "H" from the "L", which is applied through the switch 203 to the counter 204, as a result of which the counter 204 counts "1". The count signal of the binary number "1" outputted by the counter 204 is applied through the line 213 to the memories 210 and 211. Furthermore, upon depression of the switch S1, the output of the step pulse generator 207 triggers the monostable multivibrator 231, and the trigger signal is applied, as a write signal, to the other input of the NAND gate 232. As the signal "H" from the movable contacts 230*c* is applied to the one input of the NAND gate 232, the writing pulse is applied to the reading and writing terminals of the memories 210 and 211, as a result of which the binary number "1" is stored in the first address in the memory 211 in synchronization with the count signal from the counter 204. In addition, the count signal applied to the memory 211 can be synchronized with the write pulse by connecting a delay circuit (not shown) to the preceding stage of the monostable multivibrator 231. Similarly, the signal "H" from the switch SA is stored in the memory 210 with the aid of the count signal from the counter 204.

When the switch S1 is depressed again, similarly as in the above-described case, the binary number "2" is stored in the second address in the memory 211, while as the switch SA is not depressed, the signal "L" is stored in the memory 210. The two depressions of the switch S1 are counted by the counter 204, and the count signal is applied through the line 213 to the comparison circuit 215 and the display means 214, as a result of which the display lamp Lb is turned on.

If the movable contacts 227*c*, 227*f*, 227*i* and 227*l* of the switching means 227 are tripped to the contacts 227*b*, 227*e*, 227*h* and 227*k*, respectively, then the output of the encoder 208 is applied through the branch lines 219 through 222 to the decoder 212, where it is decoded and applied to the output pin OP corresponding to the above-described numeral "1". As this output pin OP is connected to the input pin IP named "Doh", the current flowing through the input pin IP passes through the resistor R which has been set to provide the frequency of the musical note "Doh", and is converted into an audio signal representing the musical tone "Doh" by the scale oscillator 228. The frequency of this audio signal is applied through the switch 236 to the amplifier 237 where it is amplified, and the musical tone is produced for the period of time corresponding to the operation period of time of the switch S1 and can be monitored. (In this case, the memory 210 and the envelope generator 235 are not related to this operation.)

The numerals indicated in the musical score in FIG. 21 represent the designation addresses in the memories 210 and 211. The notes in the musical score are stored in the memories 210 and 211 by an operation (described later) as indicated in the following table, in which a musical tone consists of a scale representing its pitch and a note representing its duration, a rest being included in the note.

| Address | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| | H | H | L | L | L | L | L | L | H | H | H | H | H | H | L | L |
| | L | L | H | H | L | L | L | L | H | H | H | H | H | H | L | L |
| Memory 211 | L | L | L | L | H | H | H | H | L | L | L | L | L | L | L | L |
| | L | L | L | L | L | L | L | L | L | L | L | L | L | L | L | L |
| Memory 210 | H | L | H | H | H | L | L | L | H | L | L | L | L | L | L | L |
| Musical tone | | Doh | Mi | Mi | | Soh | | | | | Fa | | | | Rest | |

In producing the musical tone "Mi" following the musical tone "Doh", the switches SA and S2 are simultaneously depressed once. Then, the switches SA and S2 are simultaneously depressed again for producing the next musical tone "Mi". Accordingly, the signals indicated in the above table are stored in the 3rd and 4th addresses in the memories 210 and 211.

For producing the musical tone "Soh" following the musical tone "Mi", the switch S4 is depressed while the switch SA is depressed. Then, the switch SA is released, and the switch S4 is further depressed three times. As a result, the signals indicated in the above table are stored in the 5th through 8th addresses in the memories 210 and 211.

For producing the musical tone "Fa" following the musical tone "Soh", the switch S3 is depressed while the switch SA is depressed. Then, the switch SA is released, and the switch S3 is further depressed five times. Thus, the signals indicated in the above table are stored in the 9th through 14th addresses in the memories 210 and 211.

Furthermore, for the rest, the switch S0 is depressed twice. In this case, the signals indicated in the above table are stored in the 15th and 16th addresses of the memories 210 and 211.

Similarly as in the case of the aforementioned musical tone "Doh", these musical tones "Mi", "Soh" and "Fa" are produced through the loudspeaker 238 and can be monitored when the switches S2, S3 and S4 are operated.

Now, the automatic performance will be described. The number of times of depression of the switches S1, S2, S4, S3 and S0, that is, sixteen (16) is counted by the counter 204, and the count result is displayed on the display means 214 with the binary number "16", which can be detected from the lighting of the display lamp Le. When the levers of the switches 216*a*, 216*b*, 216*c*, 216*d*, 216*f*, 216*g* and 216*h* excluding the switch 216*e* of the switching means 216 which corresponds to the display lamp Le, are tripped in one direction (as indicated in FIG. 20), the count signal applied to one input of the comparison circuit 215 by the counter 204 coincides with the signals from the switches 216*a* through 216*h*. Therefore, the output level of the comparison circuit 215 is lowered to "L"0 from "H", thereby resetting the counter 204 to its initial count state, whereupon the counter 204 outputs the count "0", as a result of which the displayed lamp Le is turned off. In addition, the memories 210 and 211 are placed in the reading state by tripping the movable contact 230*c* of the switch 230 over to the contact 230*b*. Thereafter, the movable contacts 227*c*, 227*f*, 227*i* and 227*l* of the switching means 227 are tripped over to the contacts 227*a*, 227*d*, 227*g* and 227*j*, respectively. Furthermore, the movable contact 203*c* of the switch 203 is tripped over to the contact 203*b* so as to apply the pulse signal of the clock pulse generator 203 to the counter 204.

The clock pulse generator 202 repeatedly provides a pulse signal having a period equal to the duration of the eighth note indicated in the musical score in FIG. 21, thereby determining the tempo of the music, and the pulse signal is applied through the switch 203 to the counter 204. As was described before, the counter 204 carries out its counting operation repeatedly, with the exception that the reset operation is effected by tripping the movable contact 217*c* of the switch 217 over to the contact 217*b*, with the switches except the switch 216*e* of the switching means 216 having been operated. Accordingly, with the aid of the pulse signal from the clock pulse generator 202, the counter 204 repeatedly counts the 1st through 16th addresses in the memories 210 and 211. The memory 211 operates to successively output the signals in the 1st through 16th addresses as indicated in the above table in synchronization with the counter 204. These signals are applied to the decoder 212 by switching the switching means 227.

On the other hand, the memory 210 also successively outputs the signals in the 1st through 16th addresses in the above table in synchronization with the counter 204, and the signals are applied to one input of the AND gate 233. The pulse signal of the clock pulse generator 202 is applied to the other input of the AND gate 233, and the AND gate 233 is opened only when the output signal of the memory 210 is at the "H" level. When the level of the output signal of the AND gate 233 is raised to "H" from "L", the monostable multivibrator 234 is triggered, while a tone punctuating envelope waveform is formed by the envelope generator 235 with the aid of the trigger signal. The envelope waveform thus formed is applied to the switch 236. On the other hand, the output signal from the scale oscillator 228 is also applied to the switch 236 where it is combined with the envelope waveform and is then applied to the amplifier 237, as a result of which the loudspeaker 238 is operated.

An attack effect is given to the sound from the loudspeaker 238 by the outputs of the 1st, 3rd, 4th, 5th and 9th addresses stored in the memory 210, whereby the tone punctuation is obtained.

In the above-described embodiment, the input means employs restoring type push button switches successively numbered; however, it may be a switching means including the keyboard in the piano. In this case, if the construction and arrangement of the concerned components are somewhat modified, the same effect can be obtained. That is, any switch means can be employed as the input menas if it can switch the two values "on" and "off".

In the case where the above-described output terminals OP and input terminals IP are not employed, and furthermore a music having a wide tone range is converted into digital codes which are stored in a memory means, the number of switches should be enough to cover the wide tone range. Accordingly, the number of components in the memory means is necessarily increased, and the circuit thereof becomes more intricate. On the other hand, in the case where the input terminals and the output terminals are provided, the number of the output terminals is equal to the number of kinds of scale indicated in the musical score and the switches in the input means correspond to the output terminals. Accordingly, the number of components in the memory means can be reduced, and accordingly the circuit thereof can be made simpler.

As is apparent from the above description, according to this invention, even if a musical score is unknown to the user, it can be accurately stored and reproduced with the tone pitch switch and the pulse generator. Therefore, a musical instrument for studying music and an electronic musical box capable of improving creativity can be provided. Since the operation for storage is carried out regardless of the tempo of a music, it is unnecessary for the user to have experience as to the handling of the musical box and the musical score for the storage to be effected with accuracy. This is the most significant merit of this invention. In addition, the stored music can be renewed and the tempo of the music can be changed. Since electronic components are employed for manufacturing the musical box, the size of the musical box is not much greater than that of the conventional one. Moreover, the electronic musical box according to this invention has the advantages of less trouble and longer service life associated with electronic components and can be operated by any one.

What is claimed is:

1. An electronic musical box comprising:

pulse generator means for generating a unitary pulse for a note whose duration is the shortest in a given musical score and generating integer numbers of unitary pulses for the other notes therein;

tone pitch signal generating means for generating coded tone pitch signals coded by a plurality of tone pitch switches so as to correspond to the tone pitches of the notes in said musical score;

memory means having a plurality of addresses and responsive to said pulse generator means for storing each of said coded tone pitch signals in a number of successive addresses of said memory, said number being equal to the number of unitary pulses generated by said pulse generator means; and musical tone generating means for reading data stored in said memory means thereby obtaining musical tones from the outputs of said memory means at a desired time.

2. An electronic musical box as claimed in claim 1, wherein note switches are provided in correspondence to the notes in the musical score, and the number of unitary pulses generated by said pulse generator means is determined by the operation of said note switches so that coded signals corresponding to tone pitches are stored in the said number of successive addresses of the memory means by simultaneously operating said tone pitch switches and said note switches.

3. An electronic musical box as claimed in claim 1, wherein said pulse generator means is responsive to said tone pitch signal generating means, said tone pitch switches being operated an integer multiple number of times to store coded tone pitch signals in said successive addresses in said memory means.

4. An electronic musical box as claimed in claim 1, wherein the repetition period of said pulse generator means is variable.

5. An electronic musical box as claimed in claim 2, wherein a memory element for storing the operation states of said tone pitch switches is provided, the contents of said memory element being maintained unchanged until said tone pitch switches are operated again.

6. An electronic musical box as claimed in claim 2, wherein said musical tone generating means comprises a reference frequency oscillator and a frequency divider, and the frequency division ratio of said frequency divider is changed by the output of a decoder which operates to decode an output read out of said memory means.

7. An electronic musical box as claimed in claim 3, wherein said memory means has a plurality of output terminals, and said musical tone generating means comprises a tone generator having input terminals the number of which is more than that of said output terminals; and means for connecting said memory means to said tone generator.

8. An electronic musical box as claimed in claim 1, wherein said tone pitch signal generating means is connected to said musical tone generating means so that, when at least said tone pitch switches are operated, musical tones corresponding to the signals stored in said memory means are produced.

9. An electronic musical box as claimed in claim 1, further including a timer means and a logic circuit inserted in a reading circuit of said memory means, so that the reading operation is started upon receipt of a signal from said timer means.

* * * * *